US009163829B2

(12) United States Patent
Jacobs et al.

(10) Patent No.: US 9,163,829 B2
(45) Date of Patent: Oct. 20, 2015

(54) MOVING BED HEAT EXCHANGER FOR CIRCULATING FLUIDIZED BED BOILER

(75) Inventors: Robert V. Jacobs, Windsor, CT (US); Glen D. Jukkola, Glastonbury, CT (US); George D. Mylchreest, Simsbury, CT (US); Bard C. Teigen, Enfield, CT (US); Richard E. Waryasz, Longmeadow, MA (US); Laurie Ferguson, New Hartford, CT (US); John E. Ferguson, New Hartford, CT (US)

(73) Assignee: ALSTOM Technology Ltd, Baden (CH)

( * ) Notice: Subject to any disclaimer, the term of this patent is extended or adjusted under 35 U.S.C. 154(b) by 1761 days.

(21) Appl. No.: 11/954,855

(22) Filed: Dec. 12, 2007

(65) Prior Publication Data

US 2009/0151902 A1 Jun. 18, 2009

(51) Int. Cl.

| | |
|---|---|
| ***F28D 13/00*** | (2006.01) |
| ***B01J 8/18*** | (2006.01) |
| ***F23C 10/10*** | (2006.01) |
| ***F23C 10/00*** | (2006.01) |
| ***F23C 10/32*** | (2006.01) |
| ***F28D 7/00*** | (2006.01) |
| *F28D 21/00* | (2006.01) |

(52) U.S. Cl.

CPC ..... *F23C 10/10* (2013.01); *F23C 10/005* (2013.01); *F23C 10/32* (2013.01); *F28D 7/00* (2013.01); *F28D 13/00* (2013.01); *F23C 2206/103* (2013.01); *F28D 2021/0045* (2013.01)

(58) Field of Classification Search

CPC ..... F28D 13/00; B01J 8/18; B01J 8/1881

USPC ..... 165/104.16; 422/139, 141, 145, 146

See application file for complete search history.

(56) References Cited

U.S. PATENT DOCUMENTS 3,957,419 A * 5/1976 McKenzie ..... 165/104.16
4,009,121 A * 2/1977 Luckenbach ..... 165/104.16

(Continued)

FOREIGN PATENT DOCUMENTS

EP 1 612 479 A2 7/2005
JP 2000161628 11/1998

(Continued)

OTHER PUBLICATIONS

International Search Report for PCT/US2008/084473; Mailing Date Mar. 25, 2009.

(Continued)

*Primary Examiner* — Leonard R Leo

(57) ABSTRACT

A moving bed heat exchanger (155) includes a vessel having an upper portion (200), a lower portion (210) with a floor (272) including a discharge opening therein, and an intermediate portion (205). The vessel directs a gravity flow of hot ash particles (140) received thereby from the upper portion (200) through the intermediate portion (205) to the floor (272) of the lower portion (210) of the vessel, where the hot ash particles (140) are collected. Tubes in the intermediate portion (205) of the vessel direct a flow of working fluid in a direction substantially orthogonal to the direction of the gravity flow of the hot ash particles (140) through the intermediate portion (205) of the vessel such that heat from the hot ash particles (140) is transferred to the working fluid thereby cooling the hot ash particles (140).

16 Claims, 7 Drawing Sheets

(56) References Cited

U.S. PATENT DOCUMENTS

| | | | | |
|---|---|---|---|---|
| 4,039,290 | A * | 8/1977 | Inada et al. | 422/144 |
| 4,552,203 | A | 11/1985 | Chrysostome et al. | |
| 4,614,167 | A * | 9/1986 | Bergkvist | 165/104.16 |
| 4,637,455 | A * | 1/1987 | Tordonato | 165/104.16 |
| 4,684,375 | A | 8/1987 | Morin et al. | |
| 4,709,663 | A | 12/1987 | Larson et al. | |
| 4,813,479 | A | 3/1989 | Wahlgren | |
| 4,934,282 | A | 6/1990 | Asai et al. | |
| 5,060,599 | A | 10/1991 | Chambert | |
| 5,406,914 | A | 4/1995 | Hyppanen | |
| 5,425,412 | A | 6/1995 | Hyppanen | |
| 5,570,645 | A | 11/1996 | Garcia-Mallol | |
| 5,634,516 | A | 6/1997 | Myöhänen et al. | |
| 5,840,258 | A | 11/1998 | Hyppanen | |
| 6,554,061 | B2 * | 4/2003 | Jukkola et al. | 165/104.16 |
| 6,779,492 | B2 | 8/2004 | Baglione et al. | |
| 6,938,780 | B2 | 9/2005 | Baglione et al. | |
| 2003/0015150 | A1 | 1/2003 | Belin et al. | |

FOREIGN PATENT DOCUMENTS

| | | |
|---|---|---|
| JP | 2004132621 | 10/2002 |
| WO | WO 94/11672 | 11/1993 |
| WO | WO 99/32217 | 12/1997 |
| WO | WO 99/15829 | 8/1998 |
| WO | WO 00/20818 | 9/1999 |
| WO | WO 01/35020 A1 | 11/2000 |
| WO | WO 2004/091768 A1 | 4/2004 |

OTHER PUBLICATIONS

Written Opinion of the International Searching Authority, PCT/US2008/084473, International Filing Date Nov. 24, 2008.

* cited by examiner

MOVING BED HEAT EXCHANGER FOR CIRCULATING FLUIDIZED BED BOILER

RELATED APPLICATION

The present application is related to U.S. application Ser. No. 09/740,356, filed Dec. 18, 2000 and entitled "Recuperative and Conductive Heat Transfer System" (now U.S. Pat. No. 6,554,061, issued on Apr. 29, 2003), U.S. application Ser. No. 10/451,830, filed Oct. 29, 2002 and entitled "Circulating Fluidized Bed Reactor Device" (now U.S. Pat. No. 6,779,492, issued on Aug. 24, 2004), and U.S. application Ser. No. 10/451,769, filed Oct. 29, 2002 and entitled "Centrifugal Separator in Particular for Fluidized Bed Reactor Device" (now U.S. Pat. No. 6,938,780, issued on Sep. 6, 2005), the disclosures of which are incorporated herein in their entirety by reference.

FIELD OF THE INVENTION

The present invention relates generally to fluidized bed type fossil fuel fired heat generating systems, and more particularly to the re-circulating of heated solids in a fluidized bed type fossil fuel fired heat generating system.

BACKGROUND OF THE INVENTION

Heat generating systems with furnaces for combusting fossil fuels have long been employed to generate controlled heat, with the objective of doing useful work. The work might be in the form of direct work, as with kilns, or might be in the form of indirect work, as with steam generators for industrial or marine applications or for driving turbines that produce electric power. Modern water-tube furnaces for steam generation can be of various types including fluidized-bed boilers. While there are various types of fluidized-bed boilers, all operate on the principle that a gas is injected to fluidize solids prior to combustion in the reaction chamber. In circulating fluidized-bed (CFB) type boilers a gas, e.g., air, is passed through a bed of solid particles to produce forces that tend to separate the particles from one another. As the gas flow is increased, a point is reached at which the forces on the particles are just sufficient to cause separation. The bed then becomes fluidized, with the gas cushion between the solids allowing the particles to move freely and giving the bed a liquid-like characteristic. The bulk density of the bed is relatively high at the bottom and decreases, as it flows upward through the reaction chamber where fuel is combusted to generate heat.

The solid particles forming the bed of the circulating fluidized bed boiler typically include fuel particles, such as crushed coal or other solid fuel, and sorbent particles, such as crushed limestone, dolomite or other alkaline earth material. Combustion of the fuel in the reaction chamber of the boiler produces flue gas and ash. During the combustion process, the sulfur in the fuel is oxidized to form sulfur dioxide ($SO_2$), which is mixed with the other gasses in the furnace to form the flue gas. The ash consists primarily of unburned fuel, inert material in the fuel, and sorbent particles, and is sometimes referred to as bed materials or re-circulated solids.

The ash is carried entrained in the flue gas in an upwardly flow and is exhausted from the furnace with the hot flue gas. While entrained therein and being transported by the flue gas, the sorbent particles that are present within the reaction chamber, i.e., furnace or combustor, capture, i.e., absorb, sulfur from the $SO_2$ in the flue gas. This reduces the amount of $SO_2$ in the flue gas that ultimately reaches the stack and as such the amount of $SO_2$ that is exhausted into the environment.

In order to replenish the solid particle materials that are consumed in or exhausted by the furnace, fresh fuel and sorbent particles as well as recycled ash are continuously introduced to the bed of the circulating fluidized bed boiler. Continuing, after being exhausted from the furnace, the flue gas and ash are directed to a separator, such as a cyclone, to remove the ash from the flue gas. Two parallel paths are then typically provided for re-circulating the separated ash back to the bed of the circulating fluidized bed boiler. At any given time, the separated ash may be directed along either or both of said parallel paths by a solids flow control valve located between the separator and said two parallel paths. Such solid flow control valves are well known in the art and may be controlled pneumatically, hydraulically or in some other functionally equivalent manner.

Circulating fluidized bed boilers are designed so as to operate within a narrow temperature range in order to thereby promote the combustion of fuel, the calcination of limestone and the absorption of sulfur. This narrow range of furnace temperatures must be maintained over a range of furnace loads, from full load down to some level of partial loading. The furnace temperature is controlled through absorption of heat from the flue gas and bed ash that is produced as a result of combustion in the reactor chamber of the furnace. While most of the heat absorption is through the furnace walls and the in-furnace panels, on larger circulating fluidized bed boilers, heat absorption by the furnace enclosure walls and in-furnace panels is insufficient to achieve the desired operating temperatures. For these larger circulating fluidized bed boilers, therefore, external heat exchangers are employed to absorb heat from the ash that is removed from the flue gas in the cyclone or other separator, before the ash is re-circulated to the to the circulating fluidized bed boiler. Such external heat exchangers are commonly referred to as External Heat Exchangers (EXE) or Fluid Bed Heat Exchangers (FBHEs).

Accordingly, if directed along one of the two parallel re-circulating paths, the sorbent and other ash particles are fluidized and these fluidized ash particles are then transported to and are made to flow through a FBHE by means of injected high pressure gas, e.g., air, which is normally at a pressure of about 200 inches water gage (WG). Heat is transferred from the fluidized particles to a working fluid such as water, steam, a mixture of both or some other coolant flowing through a tube bundle within the FBHE. The flow of cooled fluidized particles is then reintroduced into the furnace. The amount of cooling of the fluidized particles that is performed in the FBHE is typically controlled based on the gas temperature within the furnace that is desired.

If directed along the other one of the two parallel re-circulating paths, the sorbent and other ash particles are also fluidized and are entrained therewithin and are transported by an injected high pressure gas, such as air, again normally at a pressure of around 200 inches WG. In this case, in accordance with this path, the fluidized particles are directed through an ash re-circulation pipe having a seal, commonly referred to as a seal pot or siphon seal, that is suitably installed so as to be operative to ensure proper flow of gas and ash in the primary loop, which is defined as the furnace, the separator, i.e., cyclone, seal pot and FBHE. The seal pot functions to prevent a backflow of gas and solid particles from the furnace into the re-circulation pipe. From the seal pot, the sorbent and other solid ash particles are then reintroduced into the furnace without being cooled.

U.S. Pat. Nos. 6,779,492 and 6,938,780, which are also assigned to the same assignee as that of all of the rights in the present application, provide detailed descriptions of conventional circulating fluidized bed boilers having seal pots and FBHEs.

There remains a need for a more efficient and less expensive means for recycling ash in circulating fluidized bed boiler heat generating systems. For example, it would be beneficial if the relatively high pressure fluidizing air required by conventional FBHEs and seal pots could be eliminated, since this would reduce not only the expense of providing the required high pressure blowers and fluidizing nozzles of conventional construction, but also would reduce the dynamic loading to which the structural steel, which is required to support the FBHEs and seal pots of conventional construction is subjected, and in addition the consumption as well of power that is required to operate such high pressure blowers in order to thereby provide the necessary supply of high pressure air. Additionally, it would be beneficial to have higher heat transfer rates in the FBHE than those that are now possible when FBHEs of conventional construction are employed. Heat transfer is typically defined y the equation Q=R×S×LMTD where Heat transferred (Q=Btu/hr), Heat Transfer Rate (R=Btu/hr–Ft2–F), Surface (S=Square Feet (Ft2)) and Log Mean Temperature Difference (LTMD=Deg. F). For a constant transfer rate (R), increasing the LMTD results in a reduction of required heat exchanger surface (S) for a given heat loading. The moving bed heat exchanger (MBHE) constructed in accordance with the present invention improves on the LMTD over that in typical FBHEs by permitting full counter-flow of solids and working fluid.

OBJECTS OF THE INVENTION

Accordingly, it is an objective of the present invention to provide an improved technique for recycling the ash that is produced from the combustion of fossil fuels, such as, for example, the recycling of the ash that is produced from the combustion of fossil fuels in a circulating fluidized bed boiler.

It is another object of the present invention to provide an improved technique for removing heat during the recycling of the ash that is produced from the combustion of fossil fuels.

Additional objects, advantages, and novel features of the present invention will become apparent to those skilled in the art from the disclosure of this patent application, including the following detailed description thereof, as well as by practice of the present invention. While the present invention is described below with reference to a preferred embodiment(s), it should be understood that said invention is not limited thereto. Those of ordinary skill in the art having access to the teachings herein will recognize additional implementations, modifications, and embodiments, as well as other fields of use, which are within the scope of the present invention as said invention is disclosed and claimed herein and with respect to which said invention could be of significant utility.

SUMMARY OF THE INVENTION

In accordance with the present invention, a moving bed heat exchanger (MBHE) is provided. The MBHE could, for example, be installed in the primary recirculation loop of a circulating fluidized bed boiler with said MBHE having a vessel, a plurality of tubes, and a plurality of air inlets.

The vessel of the MBHE includes an upper portion with a feed opening, a lower portion with a floor having a discharge opening, and an intermediate portion disposed between said upper portion and said lower portion. The vessel of the MBHE receives hot ash particles, such as hot limestone particles with absorbed sulfur, via the feed opening thereof. These hot ash particles are typically received from a cyclone or other type separator after these hot ash particles have been removed from the flue gas that is exhausted from a furnace, such as the furnace of a circulating fluidized bed boiler. The vessel of the MBHE is suitably configured, i.e., is sized, shaped and/or has structural components, so as to be operative to direct a gravity flow of the hot ash particles, which are received thereby, from the upper portion of the vessel through the intermediate portion of the vessel to the floor of the lower portion of the vessel, and so as to be operative as well to collect the ash particles on the floor of the lower portion of the vessel. This directed gravity flow of the ash particles may be referred to as a "moving bed".

The plurality of tubes of the MBHE, which preferably are in the form of finned tubes, are disposed in the intermediate portion of the vessel of the MBHE and are configured so as to be operative to direct a flow of working fluid, such as water, steam, a mixture of water and steam, or some other fluid, in a direction substantially orthogonal to the direction of the directed gravity flow of the aforereferenced hot ash particles through the intermediate portion of the vessel. If the direction of the gravity flow of the aforereferenced hot ash particles is vertically downward, the flow in a direction substantially orthogonal to the direction of such gravity flow of the aforereferenced hot ash particles would be a substantially horizontal flow. The flow of the working fluid is such that heat from the hot ash particles is transferred to the working fluid to thereby cool said hot ash particles as the latter are directed to the lower portion of the vessel of the MBHE.

The plurality of air inlets of the MBHE, which will typically be in the form of air nozzles, are suitably configured so as to be operative to inject air into the lower portion of the vessel of the MBHE in order to thereby control the amount of the previously hot ash particles, which have now been cooled, that are collected and discharged through the discharge opening of the vessel of the MBHE. The amount of heat that is transferred from the hot ash particles to the working fluid will normally correspond to the amount of the previously hot ash particles, which have now been cooled, that are collected and discharged through the discharge opening of the vessel of the MBHE. Preferably, the amount of such cooled ash particles, which are collected and discharged, is controlled based on either the temperature of the gas in the furnace or the temperature of the working fluid leaving the MBHE.

Typically, in circulating fluidized bed boilers of conventional construction, air is injected at multiple locations and at various pressures. Fluidizing air injected into the furnace thereof through nozzles installed at the bottom of the furnace requires a pressure in the range of 65 inches WEG at the inlet of the nozzles. On the other hand, fluidizing air that is injected through nozzles into seal pots and FBHEs of conventional construction requires higher pressures in the range of 200 inches WG at the inlet of such nozzles. Such higher pressure is required as a direct result of the greater amount of ash that is present in terms of the height required in the seal pot and in the FBHS as compared to the height in the furnace.

In accordance with other preferred aspects of the present invention, the air that is injected fluidizes the now cooled ash particles, which have been collected, and transports these now fluidized cooled ash particles through the discharge opening of the MBHE. A discharge pipe suitably configured so as to be operative to direct the transported now fluidized cooled ash particles through the discharge opening of the MBHE may be provided. Beneficially, such a discharge pipe will have an inlet disposed within the lower portion of the vessel of the MBHE at a distance that is located above the floor of said lower portion of the vessel of the MBHE. Said inlet could, for example, be located 12 inches above the floor of the lower portion of the vessel of the MBHE, although this may vary depending on the implementation without departing from the essence of the present invention. If such a discharge pipe is provided, the now fluidized cooled ash particles are accordingly transported into the inlet of said discharge pipe and from there through the discharge opening of the vessel of the MBHE.

According to yet another aspect of the present invention, a hood is preferably disposed within the lower portion of the vessel of the MBHE at a distance that is located above the inlet of the aforereferenced discharge pipe. This hood is suitably configured so as to be operative to support the weight of the ash that is above the hood and so as to as well direct the transported ash particles that are below the hood into the inlet of the aforereferenced discharge pipe.

In accordance with still other aspects of the present invention, the above described upper, intermediate and lower portions of the vessel of the MBHE form a first compartment of the vessel of the MBHE, and said vessel also includes a second compartment that includes another separate feed opening and another floor having another separate discharge opening. Said vessel receives other ash particles, which are also hot, via the other feed opening thereof. Said vessel is also further configured so as to be operative to direct a gravity flow of the hot other ash particles received thereby to the floor of the second compartment thereof and so as to be operative as well to collect said hot other ash particles on this other floor thereof. A plurality of other air inlets preferably is also provided. Said plurality of other air inlets, which will typically also be in the form of air nozzles, are suitably configured so as to be operative to inject air into the second compartment of the vessel of the MBHE in order to thereby control the amount of the hot other ash particles, which are collected and discharged through the other discharge opening of the vessel of the MBHE. Thus, both cooled particles from one compartment and hot particles from the other compartment can be discharged, e.g., for recycling to the furnace of a circulating fluidized bed boiler.

Beneficially, the amount of hot other ash particles, which are collected and discharged through the other discharge opening of the vessel of the MBHE, is controlled such that the amount of the hot other ash particles collected on the floor of the second compartment of the vessel of the MBHE is sufficient to seal the second compartment of the vessel of the MBHE against a flow of an external gas through the discharge opening of the vessel of the MHE into the second compartment of the vessel of the MBHE. Accordingly, the present invention can be implemented to provide a MBHE and a seal pot unit, which are integrated.

ENABLING DESCRIPTION OF A PREFERRED EMBODIMENT

Figure 1:
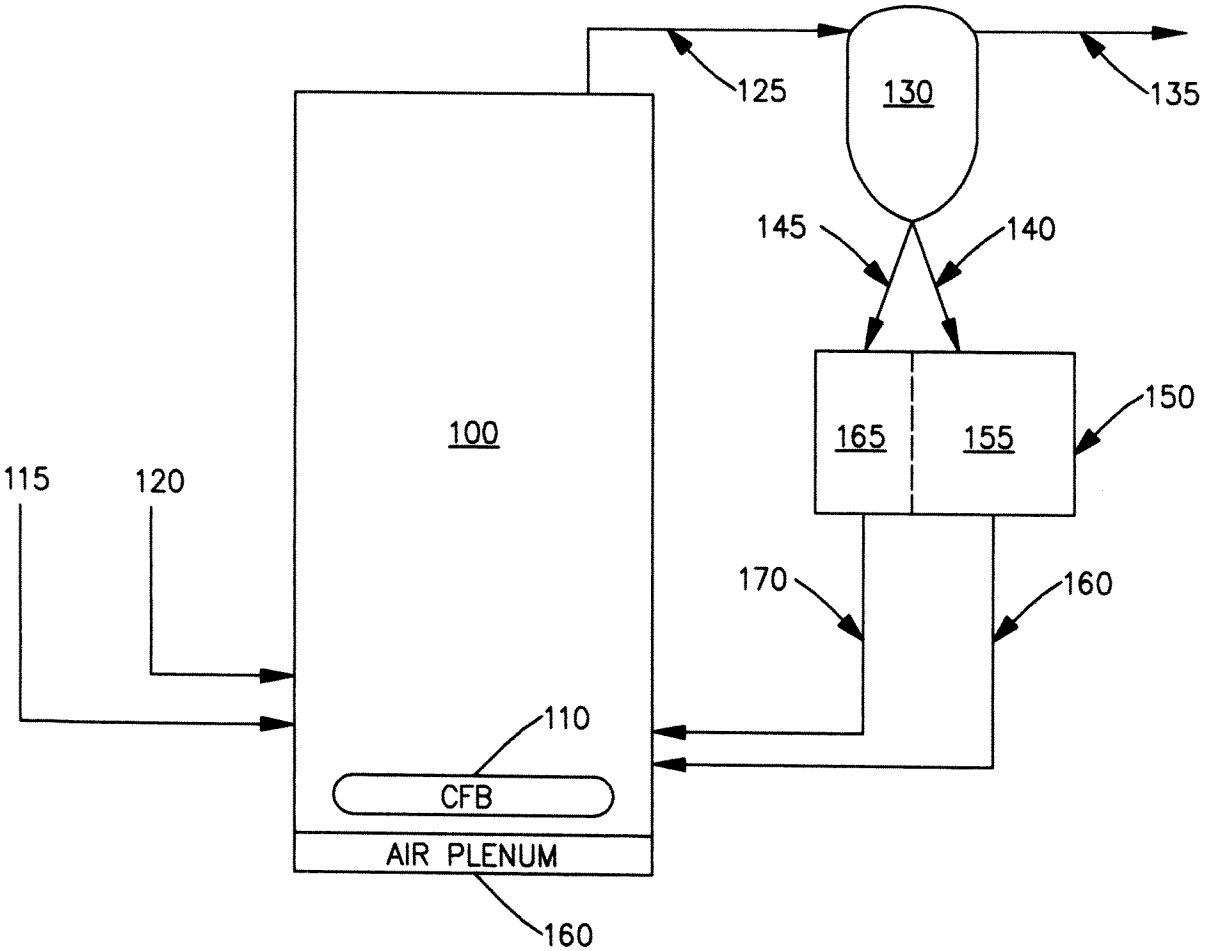
FIG. 1 depicts a simplified elevational view of the primary loop of a circulating fluidized bed boiler consisting of a furnace and an integrated unit that includes a moving bed heat exchanger (MBHE) and a seal pot, constructed in accordance with the present invention.

In FIG. 1 of the drawings there is illustrated a circulating fluidized bed boiler 100 embodying a circulating fluidized bed 110. As best understood with reference to FIG. 1, fresh fuel, typically crushed coal, is fed to the circulating fluidized bed 110 via a conveying line 115, and fresh sorbent, commonly crushed limestone, is fed also to the circulating fluidized bed 110 via a conveying line 120.

In addition, with further reference to FIG. 1 recycled hot ash is also transported from a seal pot 165 to the circulating fluidized bed 110 via a conveying line 170. Additionally, recycled cool ash is also transported from a moving bed heat exchanger (MBHE) 155 to the furnace, i.e., reaction chamber, of the circulating fluidized bed boiler 100 via a conveying line 160.

Continuing a plenum 160, as illustrated in FIG. 1, supplies air to the fresh fuel, fresh sorbent and recycled ash particles that are fed to the furnace of the circulating fluidized bed boiler 100 in order to thereby fluidize these particles of fresh fuel, fresh sorbent and recycled ash so as to thereby create therefrom the circulating fluidized bed 110 in a manner well-known to those skilled in this art.

The flue gas and ash generated in the furnace of the circulating fluidized bed boiler 100 are exhausted from the furnace of the circulating fluidized bed boiler 100 via a conveying line 125. As is well understood, the flue gas serves as a carrier and transports the ash entrained therewith from the furnace of the circulating fluidized bed boiler 100.

A cyclone 130 is employed to separate from the flue gas the ash that is entrained therewith. From the cyclone 130, the flue gas, which is now substantially free of the ash previously entrained therewith, is transported via a conveying line 135 preferably to any downstream processing equipment, e.g., heat exchangers, air pollution control (APC) equipment, and thereafter ultimately to an exhaust stack.

The ash after being separated from the flue gas in the cyclone 130 is directed from the cyclone 130 to a moving bed heat exchanger (MBHE) 155 via a first path 140 and then to a seal pot 165 via a second path 145. As best understood with reference to FIG. 1 of the drawings, the MBHE 155 and the seal pot 165 are housed in an integrated unit denoted in the drawings by the reference numeral 150.

Figure 2:
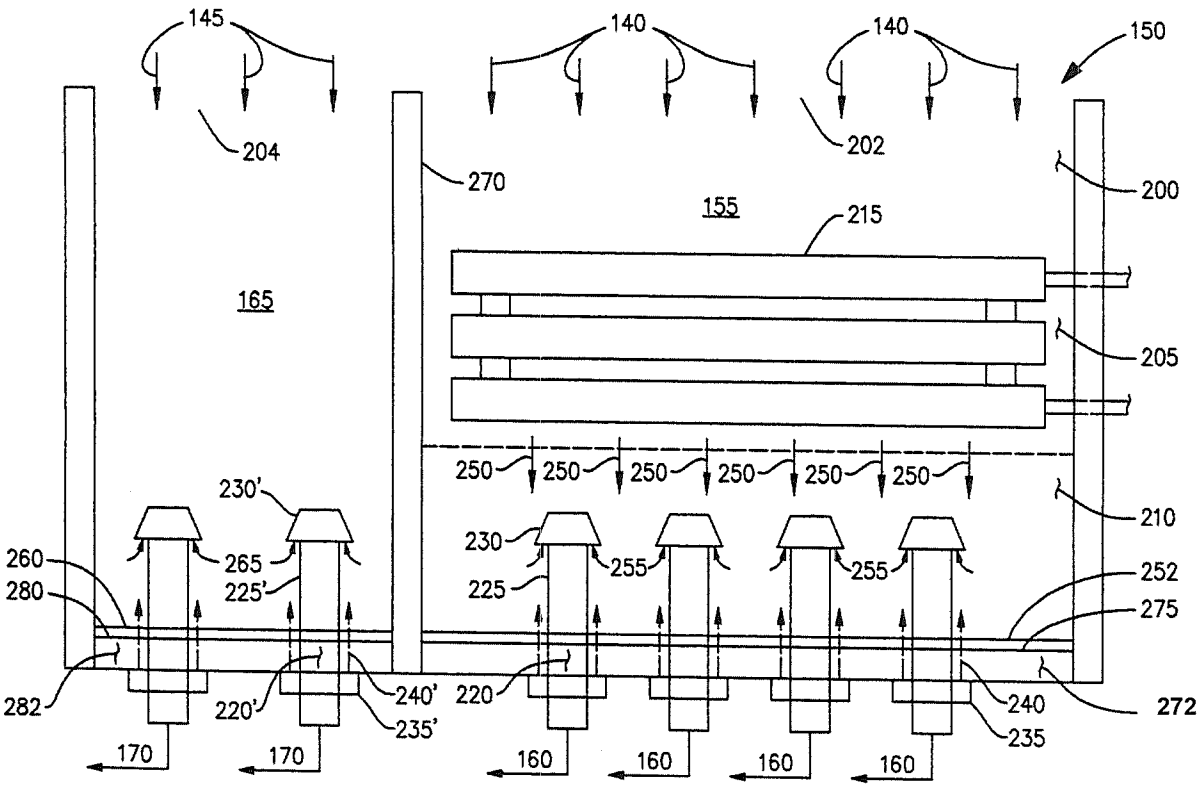
FIG. 2 is an elevational view presenting a more detailed depiction of the integrated unit of a MBHE and a seal pot that is illustrated in FIG. 1, constructed in accordance with the present invention.

In FIG. 2 there is illustrated the details of the MBHE and the seal pot integrated unit 150. As best understood with reference to FIG. 2 of the drawings, hot ash particles 140 from the cyclone separator 130 are fed into the MBHE 155 in a distributed manner. That is, preferably, the hot ash particles that enter the MBHE 155 are distributed across the width and depth of the MBHE 155. Similarly, the hot ash particles 145, as best understood with reference to FIG. 2 of the drawings, are also fed in a distributed manner to the seal pot 165. The hot ash particles 140 move through the MBHE 155 and the hot ash particles 145 move through the seal pot 165 each by means of a gravity flow. This gravity flow of the ash particles 140 and 145 may be referred to as a "moving bed".

With further reference to FIG. 2, as illustrated therein the MBHE 155 has three primary portions; namely, an upper portion 200, an intermediate portion 205 and a lower portion 210. To this end, the moving bed of ash particles 140 enters the upper portion 200 of the MBHE 155 through what may be referred to as a feed opening 202, which is depicted at the top of the MBHE 155 in FIG. 2. This opening 202 can be suitably configured in any number of ways without departing from the essence of the present invention, as will be well understood by those skilled in this art.

The MBHE 155 is suitably sized, shaped and/or has structural components (not shown in the interest of maintaining clarity of illustration in the drawings) so as to be operative to direct the moving bed of hot ash particles 140 from the upper portion 200 thereof to the immediate portion 205 thereof of the MBHE 155. The intermediate portion 205 includes a heat exchanger 215 typically consisting of boiler pressure parts. These pressure parts preferably include a bundle of finned tubes (not shown in the interest of maintaining clarity of illustration in the drawings) through which a working fluid, generally in the form of steam and/or of water, flows. This working fluid serves as a coolant, and is used to recover heat from the moving bed of hot ash particles 140 as the hot ash particles 140 are made to flow through the heat exchanger 215.

The bundle of finned tubes of the heat exchanger 215 are preferably oriented such that the flow of the working fluid therethrough is substantially orthogonal to the gravity flow of the moving bed of hot ash particles through the heat exchanger 215. The fins beneficially extend from the tubes in a direction that is substantially parallel to the direction of flow of the moving bed of hot ash particles. After passing through the heat exchanger 215, the cooled ash particles denoted in FIG. 2 by the reference numeral 250 are made to flow to the lower portion 210 of the MBHE 155. The cooled ash particles 250 are then collected on the surface 275 of the floor 272 of the lower portion 210 of the MBHE 155. A layer of such collected cooled ash particles are identified by the reference numeral 252 in FIG. 2. The pressure of the collected cooled ash particles is relatively high, e.g., 200 inches water gage (WG).

As best understood with reference to FIG. 2, air plenums 235 are disposed below the floor 272 of the MBHE 155 in order to thereby provide a flow of low pressure air 240, e.g., at a pressure of 65 inches WG, into the lower portion 210 of the MBHE 155 through air inlets in the floor 272 of the MBHE 155. Further details regarding the flow of the low pressure air 240 into the lower portion 210 of the MBHE 155 will be discussed hereinbelow. Injection of the low pressure air 240 is operative to cause the collected cooled ash particles 252 to be transported through a discharge opening 220 in the floor 272 of the MBHE 155. Preferably, a discharge pipe 225 extends from a position above the floor surface 275 through each of the floor discharge openings 220. In accordance with the preferred embodiment of the present invention, a hood 230 is provided above the inlet opening 227 (as best understood with reference to FIG. 4) of each respective one of the discharge pipes 225. If such a discharge pipe 225 and hood 230 is utilized for purposes of effecting the discharge of the collected cooled ash particles 252 therewith, collected cooled ash particles 252 are transported by the low pressure air 240 to a position located above an inlet opening of each respective one of the discharge pipes 225. The collected cooled ash particles that are being transported are identified in FIG. 4 by the reference numeral 255. Each hood 230 is operative to deflect the transported collected cooled ash particles 255 into the inlet 227 of, and through, a respective one of the discharge pipes 225. The transported collected cooled ash particles 255 leaving the discharge pipe 225 are re-circulated to the furnace of the circulating fluidized bed boiler 100 via conveying line 160.

As best seen with reference to FIG. 2 of the drawings, a common wall 270 separates the MBHE 155 from the seal pot 165. The hot ash particles 145 enter the seal pot 165 through a feed opening 204 as is illustrated in FIG. 2. The hot ash particles 145 are subjected to a gravity flow in the seal pot 165, that is, from the feed opening 204 of the seal pot 165 to the surface 280 of the floor 282 of the seal pot 165. As depicted in FIG. 2, a layer of collected hot ash particles 260 forms on the surface 280 of the floor 282 of the seal pot 165. The seal pot 165 also includes air plenums denoted by the reference numeral 235' that are designed to be operative for injecting air to transport the collected hot ash particles 260 through the discharge openings 220' in the floor 280 of the seal pot 165. The hot ash particles that are being so transported are identified in FIG. 2 by the reference numeral 265. As with the MBHE 155, a hooded discharge pipe 225' is preferably mounted through each of the discharge openings 220' in order to thereby form the passageways through which the hot ash particles 265 are capable of being discharged from the seal pot 165. The hot ash particles 265 that are discharged from the seal pot discharge openings 220' are designed to be re-circulated back to the circulating fluidized bed boiler 100 via a conveying line 170.

By controlling the injection of air 240 into the MBHE 155, the amount of collected cooled ash particles 252 that are discharged through the discharge openings 220 in the MBHE 155 can be controlled. Similarly, by controlling the injection of air 240' into the seal pot 165, the amount of the collected hot ash particles 260 that are discharged through the discharge openings 220' can also be controlled. By controlling the injection of low pressure air 240 to the MBHE 155, the amount of heat transferred from the hot ash particles 140 to the working fluid flowing in the heat exchanger 215 can also be controlled. That is, the amount of heat transferred from the hot ash particles 140 to the working fluid will correspond to the amount of collected cooled ash particles 250 that are discharged through the discharge openings 220. This control is preferably effected based on the temperature of the gas in the furnace of the circulating fluidized bed boiler 100 or the steam/water temperature in the MBHE 155, but could equally well be based on other furnace related parameters without departing from the essence of the present invention.

In summary, the integrated MBHE and seal pot unit 150 can be used to control the combustion temperature in the furnace of the circulating fluidized bed boiler 100. Since the ash moves through the MBHE 155 and across the heat exchanger 215 in a gravity flow, the injection of high pressure air in order to thereby transport the ash and induce the heat transfer is not required. Thus, there is no requirement in accordance with the present invention for employing any high pressure fluidizing blowers. As a result, this significantly reduces not only material cost but also power consumption. The counter current flow of the moving bed of ash vertically downward in the MBHE 155 results in higher log mean temperature difference (LMTD), which contributes to higher heat transfer rates in the MBHE 155 and thus reduced heat exchanger surface requirements. Furthermore, because the MBHE 155 is capable of utilizing a plurality of finned tubes that embody a high fin density without hindering the flow of ash therethrough, the heat transfer surface can be arranged in a very compact design. The extended surface resulting from the use of a plurality of tubes that embody high density fins coupled with the high LMTD, renders it possible to realize as a consequence thereof significant reductions in pressure part surfaces and refractory compared with that which is necessary when fluidized bed heat exchangers (FBHEs) of conventional construction are being employed. Furthermore, because the rate of ash flow is controlled in the MBHE 155 by means of the controlling of the discharge of ash downstream of the heat exchanger, there is no need for an ash control valve to be employed upstream of the seal pot 165 and the MBHE 155. This is in contrast to the need for employing an upstream ash control valve to control the solid flow in FBHEs that embody a conventional construction.

Figure 3:
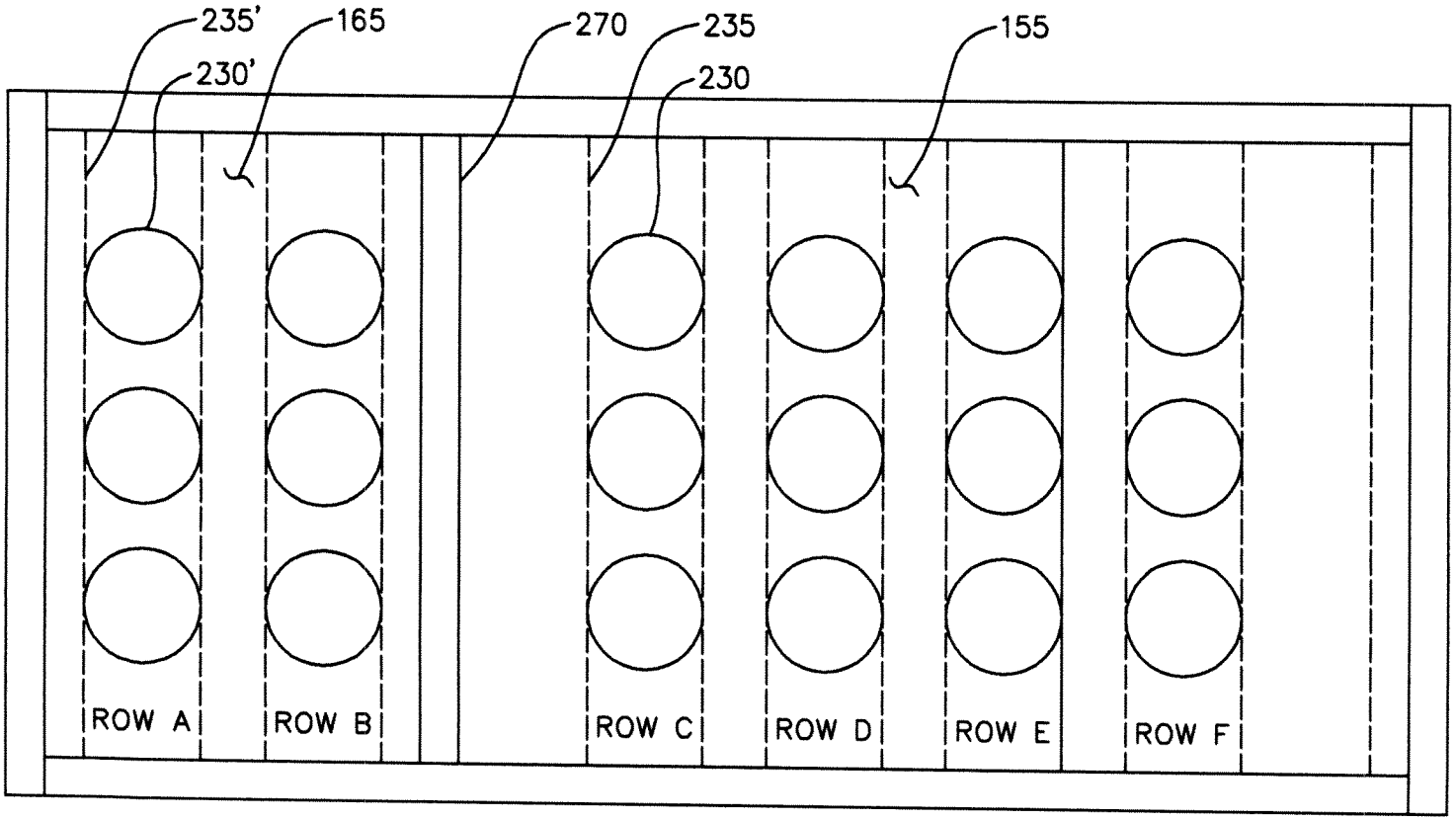
FIG. 3 is a plan view depicting a preferred arrangement of the air plenums and discharge pipes that are illustrated in FIG. 2, constructed in accordance with the present invention.

FIG. 3 is a plan view, by way of exemplification, of a preferred arrangement of the air plenum, and pipe and hood discharges in accordance with the present invention, which are sometimes referred to as low pressure ash control valves (LPACVs). As will be best understood with reference to FIG. 3, the LPACVs are distributed throughout the floor area of both the MBHE 155 and the seal pot 165. To this end, each row A-F of LPACVs is controlled by air, which is injected via an individual plenum 235 or 235'. In a manner that will be discussed in greater detail hereinafter, the air, which is supplied to the individual plenums 235 or 235', may be controlled individually. It should be understood that the number of rows of LPACVs in the seal pot 165 and the MBHE 155 may, without departing from the essence of the present invention, vary depending on the particular application in which the LPACVs are being employed. Furthermore, the number of discharge openings in each row may, without departing from the essence of the present invention, also vary depending on the particular application in which the LPACVs are being employed. Higher air flow rates from the plenums 235 in the MBHE 155 are operative to promote increased ash flow rates across the heat exchanger 215, and hence lower aggregate temperatures of the ash that is returned to the furnace of the circulating fluidized bed boiler 100 from the MBHE 155.

The air, which is injected into the MBHE 155 and the seal pot 165, is controlled in order to thereby cause a specific level, i.e., quantity, of ash to be maintained in the MBHE 155 and the seal pot 165 so as to thus provide the required furnace to cyclone seal. In addition, the injection of air into the MBHE 155 is also controlled in order to thereby control the flow of ash across the heat exchanger 215 so as to thus achieve a specific steam generator parameter, such as, for example, a specific gas or steam temperature within the furnace of the circulating fluidized bed boiler 100. Finally, the injection of air into the MBHE 155 and the seal pot 165 is also controlled in order to thereby maintain an even distribution of the cooled and hot ash particles in the ash return lines 160 and 170 to the furnace of the circulating fluidized bed boiler 100. By virtue of the arranging of the discharge openings in rows and the regulating of the air, which is injected for purposes of effecting the transport of the ash through each row of the discharge openings 220 or 220', an even ash flow can be thereby ensured across the width of the MBHE 155 and of the seal pot 165 and in each of the return lines 160 and 170 as well. Furthermore, the regulation of the ash discharge from the rows A-F is further operative to promote even coolant temperatures within the tubes of the heat exchanger 215. Moreover, because the MBHE 155 and seal pot 165 are capable of being controlled independently of each other without departing from the essence of the present invention, if such is desired, the MBHE 155 is capable of being operated with the seal pot 165 shut down or visa versa. With the seal pot 165 and MBHE 155 being arranged in parallel relation to each other, large particles, which are discharged from the cyclone 130 can without departing from the essence of the present invention, if such is desired, be channeled away from the MBHE 155 for purposes of being discharged out through the seal pot 165.

Figure 4:
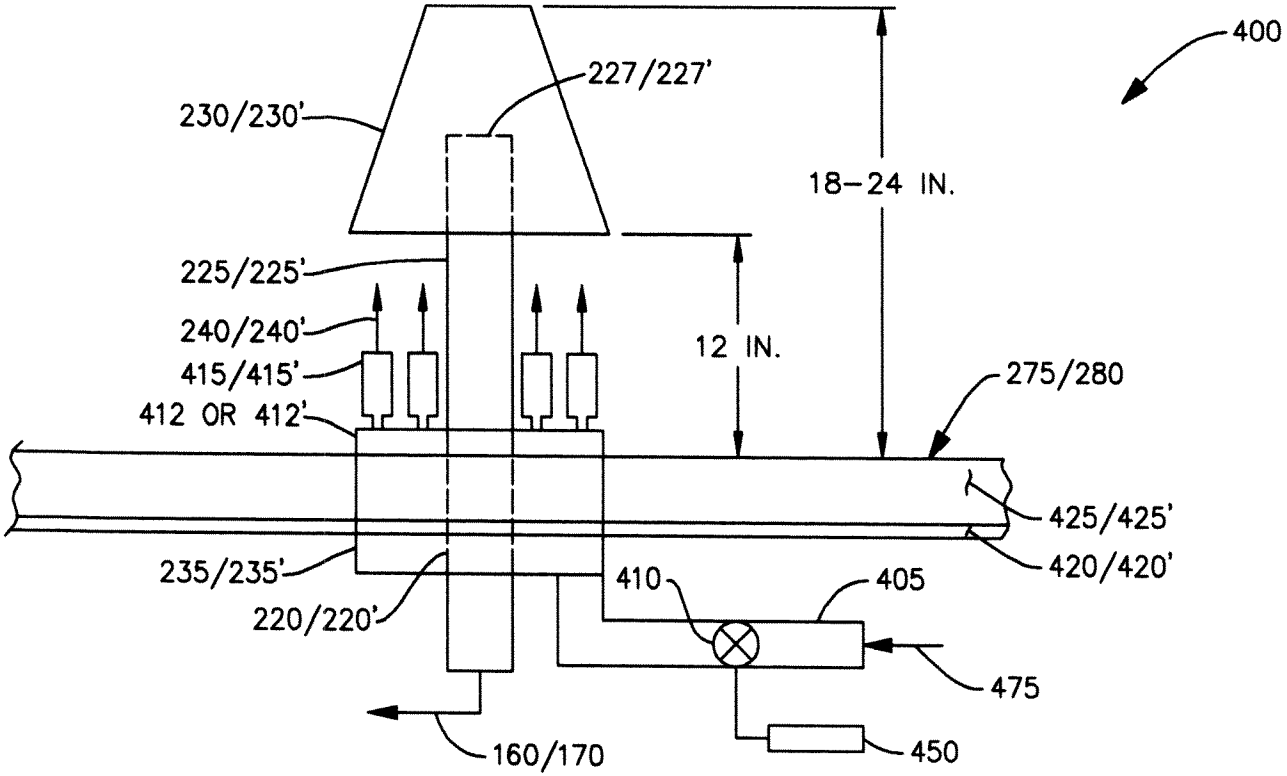
FIG. 4 shows an enlarged and more detailed depiction of components used to control the discharge of ash from the integrated unit of a MBHE and a seal pot that are illustrated in FIG. 2, constructed in accordance with the present invention.
Figure 5:
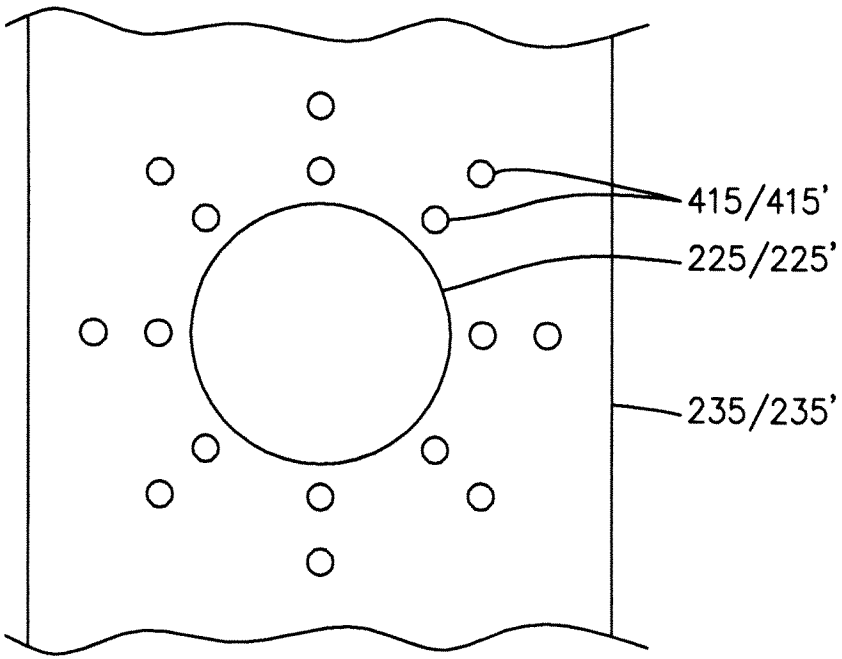
FIG. 5 is a plan view showing an exemplary arrangement of the orifices of the air nozzles that are illustrated in FIG. 4, constructed in accordance with the present invention.

In FIGS. 4 and 5 of the drawings, there is further illustrated a LPACV 475 for controlling the flow of ash through the discharge openings 220 and 220' in the MBHE 155 and the seal pot 165. As best understood with reference to FIG. 4, the LPACV 475 includes the discharge pipe 225 or 225' and the associated hood 230 or 230' that have been previously described hereinbefore. To this end, the discharge pipe 225 or 225' extends through the discharge opening 220 or 220' in the floor 272 or 282 of the MBHE 155 or the seal pot 165. With further reference to FIG. 4, as illustrated therein the floor of each of the MBHE 155 and the seal pot 165 includes a steel casing 420 or 420', respectively, on which a layer of refractory material 425 or 425', respectively, is preferably provided in accordance with the present invention. Continuing with reference to FIG. 4, the discharge opening 220 or 220' is formed so as to extend through both the refractory material 425 or 425' and the steel casing 420 or 420'. Preferably the discharge pipe 225 or 225' in accordance with the present invention extends approximately 12 inches above the floor surface 275 or 280, although the height of the discharge pipe 225 or 225' may vary without departing from the essence of the present invention depending on the nature of the particular application in question. As best understood with reference to FIG. 4, the hood 230 or 230' is preferably supported off the discharge pipe 225 or 225' itself and in addition preferably also extends to a height of between 18 and 24 inches above the floor 272 or 282. However, it is also to be understood that this height range may also in addition vary without departing from the essence of the present invention. As can be seen with reference to FIG. 4, the bottom of the hood 230 or 230' preferably but not necessarily extends below the inlet opening 227 in the case of MBHE 155 and below the inlet opening 227' in the case of the seal pot 165.

Air denoted in the drawings by the reference numeral 475 from a suitable source thereof (not shown in the interest of maintaining clarity of illustration in the drawings) is fed via a duct 405 to the plenum 235 or 235' which is operative to distribute such air, which in turn effects the feed thereof to a manifold 412, in the case of the MBHE 155, or to the manifold 412', in the case of the seal pot 165. From the manifold 412 or 412' such air is distributed to the individual low pressure air nozzles 415, in the case of the MBHE 155, and to the lower pressure air nozzles 415', in the case of the seal pot 165, for injection thereafter into the MBHE 155 or the seal pot 165, as applicable. The flow of air via the duct 405 to the plenum 235 or 235' is controlled, in accordance with the preferred embodiment of the present invention, by a variable air flow valve 410 in response to instructions received thereby from the controller 450. The controller 450 is operative to effect the control of a separate variable air flow control valve 410 that is associated with each controller 450. All the valves 410 may, if such is desired, be controlled without departing from the essence of the present invention by a single controller 450.

In FIG. 5 of the drawings, there is depicted one of numerous arrangements of the air nozzles 415 or 415' that could be utilized without departing from the essence of the present invention for purposes of effecting the injection of the low pressure air 240 or 240' into the MBHE 155 or the seal pot 165. Arranging the low pressure air nozzles 415 or 415' so as to thereby function in the required manner is well understood by those skilled in this art, and accordingly it should be understood that the arrangement of the nozzles that is illustrated in FIG. 5 is by way of exemplification and not limitation, and that any number of other nozzle arrangements could equally well be utilized without departing from the essence of the present invention.

In operation, a small amount of low pressure air 240 or 240' is injected to control the solids within the MBHE 155 and the seal pot 165. To this end, the pressure of the injected air is much lower than the surrounding pressure of the solids.

The pressure of the solids on the floor of the compartment that defines the MBHE 155 and on the floor of the compartment that defines the seal pot 165, corresponds to the height of the solids in the respective one of the aforementioned compartments. In most cases, the pressure of the solids in such compartments will be well in excess of 200 inches WG. However, the pressure of the air 240 or 240' injected into the respective compartment need only be a low pressure. Such low pressure air can be provided for this purpose from a primary or secondary air source that is commonly available at circulating fluidized bed boiler plants. For example, such primary air, which is generally so available at a pressure of 65 inches WG, can be utilized as the source of the air 475.

The short height of the discharge pipe 225 or 225' above the floor surface 275 or 280 effectively enables the height of the bed of collected ash 252 or 260 to be reduced concomitantly, and hence the amount of pressure that is required in order to effect the transport of the solids to the discharge pipe inlet 227 or 227'. The injected air 240 or 240' is designed to effectively bubble up through the collected ash 252 and 260 and is then deflected by the hood 230 or 230' into the discharge pipe inlet 227 or 227', and through the discharge pipe 225 or 225' into the conveying line 160 or 170. During this process, the low pressure air effects the transport of the ash from the MBHE 155 and/or seal pot 165 to the furnace of the circulating fluidized bed boiler 100. As the ash is so transported from the respective compartment, the bed of ash moves in a downwardly direction thereby promoting a heat transfer therefrom to the working fluid flowing through the tubes of the heat exchanger 215.

Figure 6:
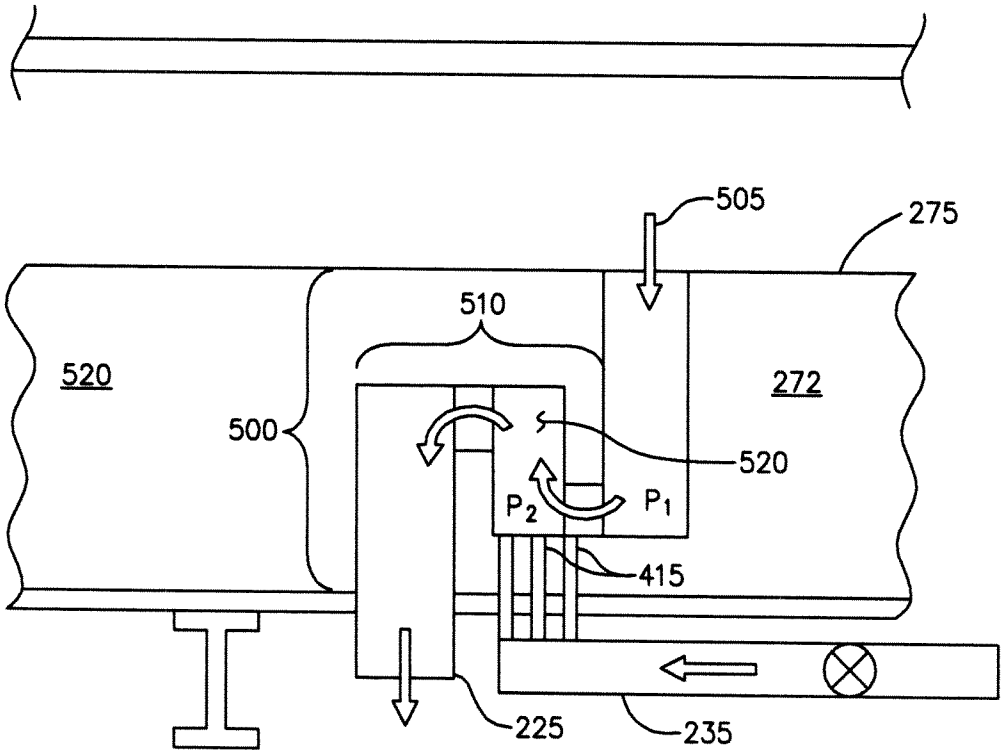
FIG. 6 shows an enlarged and more detailed depiction of a first alternative form of components used to control the discharge of ash from the integrated unit of a MBHE and a seal pot that are illustrated in FIG. 2, constructed in accordance with the present invention.
Figure 7:
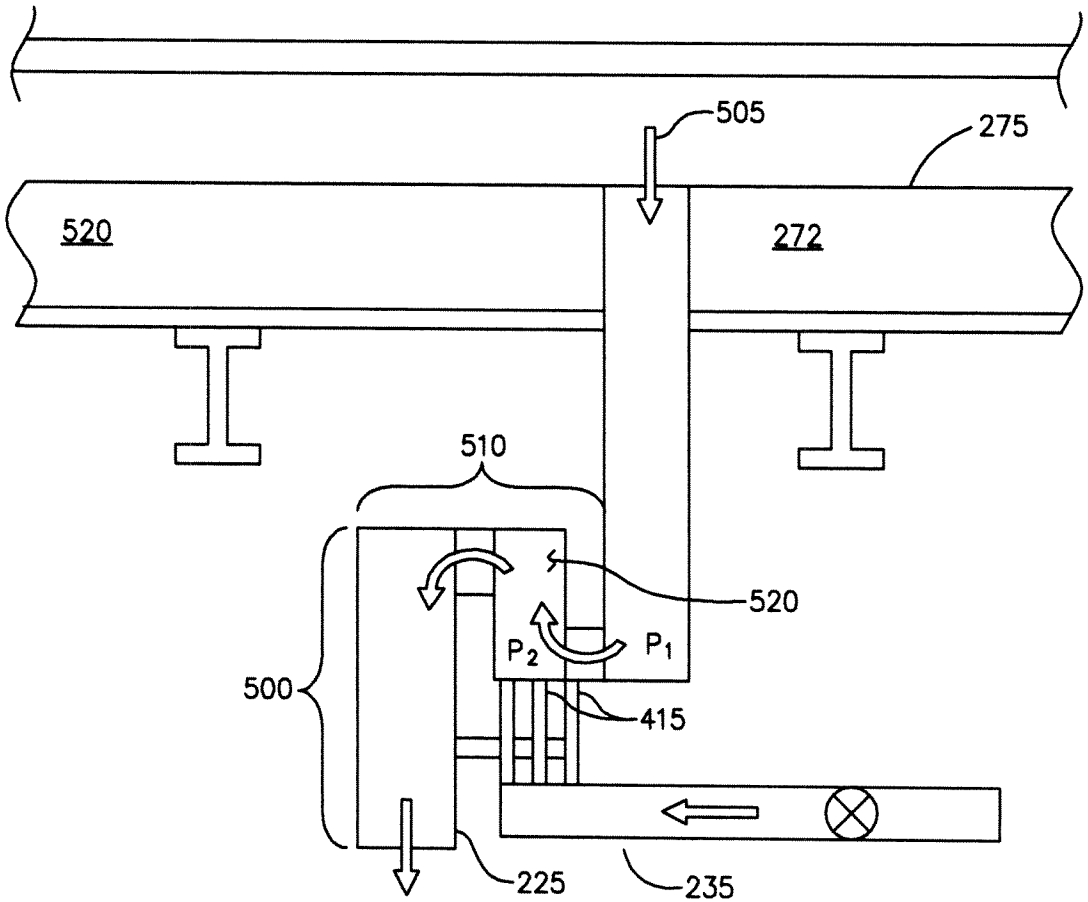
FIG. 7 shows an enlarged and more detailed description of a second alternative from of components used to control the discharge of ash from the integrated unit of a MBHE and a seal pot that are illustrated in FIG. 2, constructed in accordance with the present invention.

In FIGS. 6 and 7 of the drawings, there is illustrated an alternative LPACV design 500 that can be employed in the MBHE 155 without departing from the essence of the present invention. Moreover, this alternative LPACV design 500 can be installed in the floor 272 or below the floor 272 of the MBHE 155. To this end, in this alternative LPACV design 500 there is utilized the same hydrodynamic principles as the LPACV that is illustrated in FIG. 4 of the drawings. The LPACV design 500 that is illustrated in FIGS. 6 and 7 of the drawings differs from the LPACV design that is illustrated in FIG. 4 of the drawings in that in the LPACV design 500 a labyrinth chamber 520 is utilized for purposes of forming the hood 510 whereby the lower pressure condition P2 that is achieved versus the higher pressure condition P1 is formed by the static head of the material of the circulating fluidized bed material 110.

The controller 450 is capable of controlling the variable air flow valve 410 in order to thereby effect a pulsation of air through the nozzles 415 or 415' in an on-off sequence. Alternatively, the controller 450 also is capable of controlling the variable air flow valve 410 such that the injectors 415 or 415' inject a continuous stream of low pressure air at varying flow rates into the respective compartment.

In summary, a non-mechanical control of ash flow across the MBHE 155 and the seal pot 165 is provided utilizing air at a pressure far lower than the surrounding pressure of the ash collected on the respective compartment floor. Because only low pressure air is required, the power usage of the circulating fluidized bed boiler plant can thereby be reduced, and hence the circulating fluidized bed boiler plant can operate at a higher energy efficiency, e.g., a higher plant heat rate. Furthermore, the amount of ash being discharged from the MBHE 155 and the seal pot 165 can be effectively controlled to the desired extent over the full load range of the circulating fluidized bed boiler 100.

As described above, in accordance with the present invention a more efficient and less expensive technique for recycling ash in circulating fluidized bed heat generating systems is provided. This technique to which the present invention is directed beneficially eliminates the need for the relatively high pressure fluidizing air that is required by FBHEs and seal pots, which are of conventional construction, and can reduce not only the expense of the high pressure blowers and fluidizing nozzles that are commonly required therefor, but also the dynamic loading to which the structural steel, which is required for purposes of supporting FBHEs and seal pots that embody a conventional construction, is subjected. The consumption of power conventionally required to operate such blowers in order for them to thereby provide the supply of high pressure air is also eliminated. Additionally, this technique to which the present invention is directed beneficially facilitates higher heat transfer rates in the heat exchanger than those now possible using conventionally constructed FBHEs because of the relatively low log mean temperature difference LMTD of the fluidized ash flow within such conventionally constructed FBHEs.

While a preferred embodiment of our invention has been described and illustrated herein, it will be appreciated that modifications thereof, some of which have been alluded to hereinabove, may still be readily made thereto by those skilled in the art. We, therefore, intend by the appended claims to cover the modifications alluded to herein as well as all the other modifications that fall within the true spirit and scope of our invention.

We claim:

1. A moving bed heat exchanger, comprising:

a vessel including an upper portion having a hot ash feed opening, a lower portion having a floor including a discharge opening therein, and an intermediate portion disposed between said upper portion and said lower portion, said vessel being configured so as to thereby direct a gravity flow from said upper portion through said intermediate portion to said floor of said lower portion of said vessel of hot ash particles received in said vessel via said feed opening and to effect the collection of said hot ash particles on said floor of said lower portion of said vessel;

a plurality of tubes disposed only in said intermediate portion of said vessel and configured so as to thereby direct a flow of working fluid in a direction substantially orthogonal to the direction of the directed gravity flow of said hot ash particles through said intermediate portion of said vessel, such that heat from said hot ash particles is transferred to said working fluid to thereby cool said hot ash particles as the gravity flow of said hot ash particles is directed to said lower portion of said vessel;

a discharge pipe extending through the discharge opening into the lower portion of the vessel;

a hood arranged as a low pressure ash control valve including a labyrinth chamber formed at said floor;

an air inlet is configured to inject air into the hood for driving collected cooled hot ash particles through an inlet opening of the discharge pipe and said discharge opening of said vessel by creating a pressure condition in the hood that is lower relative to a pressure formed by a static head of the collected cooled ash; and the floor is configured to collect hot ash particles only in the lower portion of the vessel.

2. The moving bed heat exchanger as claimed in claim 1, wherein:

the amount of the heat transferred from said hot ash particles to said working fluid corresponds to the amount of the collected cooled hot ash particles that are discharged through said discharge opening of said vessel.

3. The moving bed heat exchanger as claimed in claim 1, wherein:

the amount of the collected cooled hot ash particles that are discharged through said discharge opening of said vessel is controlled based on the temperature of the gas in a furnace that is operatively connected to said vessel and to which are directed the collected cooled hot ash particles that are discharged through said discharge opening of said vessel.

4. The moving bed heat exchanger as claimed in claim 1, wherein:

said relatively higher pressure of said collected cooled hot ash particles is approximately 200 inches WG; and said relatively lower pressure of the air injected by said plurality of air inlets is approximately 65 inches WG.

5. The moving bed heat exchanger as claimed in claim 1, wherein:

the air injected by said air inlet is operative to fluidize said collected cooled hot ash particles and to transport said collected cooled hot ash particles through said discharge opening of said vessel.

6. The moving bed heat exchanger as claimed in claim 1, wherein said feed opening is a first feed opening, said floor is a first floor, said discharge opening is a first discharge opening, said air inlet is a first air inlet, and said hot ash particles are first hot ash particles, and further comprising:

a plurality of second air inlets;

wherein said upper portion, said intermediate portion and said lower portion form a first compartment of said vessel;

wherein said vessel also includes a second compartment with a second feed opening and a second floor including a second discharge opening therein, said vessel being further configured so as to be operative to thereby direct a gravity flow to said floor of said second compartment of second hot ash particles received in said vessel via said second feed opening and to effect the collection of said second hot ash particles on said second floor of said second compartment;

wherein said plurality of second air inlets is configured to inject air into said second compartment of said vessel to control the amount of said collected second hot ash particles that are discharged through said second discharge opening of said second compartment.

7. The moving bed heat exchanger as claimed in claim 6, wherein:

the amount of said collected second hot ash particles that are discharged through said second discharge opening of said second compartment is controlled such that the amount of said second hot ash particles collected on said floor of said second compartment is sufficient to seal said second compartment against a flow of an external gas through said second discharge opening into said second compartment.

8. The moving bed heat exchanger as claimed in claim 1, wherein:

the plurality of tubes disposed in said intermediate portion of said vessel are configured as finned tubes.

9. A method of recouping heat from hot ash particles in a moving bed heat exchanger, the moving bed heat exchanger including, a vessel including an upper portion having a hot ash feed opening, a lower portion having a floor including a discharge opening therein, and an intermediate portion disposed between the upper portion and the lower portion, a plurality of tubes disposed only in the intermediate portion of the vessel, a discharge pipe extending through the discharge opening into the lower portion of the vessel, a hood arranged as a low pressure ash control valve including a labyrinth chamber formed at said floor, an air inlet, the floor configured to collect hot ash particles only in the lower part of the vessel the method comprising the steps of:

directing a gravity flow of hot ash particles from the upper portion through the intermediate portion to the floor of the lower portion of the vessel of hot ash particles received in the vessel via the feed opening and for collecting the hot ash particles on the floor of the lower portion of the vessel;

directing a flow of working fluid along a path intersecting the gravity flow of the hot ash particles and in a direction substantially orthogonal to the direction of the gravity flow of the hot ash particles through the intermediate portion of the vessel so as to thereby transfer heat from the hot ash particles to the working fluid for cooling of the hot ash particles;

collecting the cooled hot ash particles in a collector;

injecting air through the air inlet into the hood to drive collected cooled hot ash particles of the collection of hot ash particles through an inlet opening of the discharge pipe and said discharge opening of said vessel by creating a pressure condition in the hood that is lower relative to a pressure formed by a static head of the collected cooled ash to a furnace.

10. The method as claimed in claim 9, wherein:

the amount of heat transferred from the hot ash particles to the working fluid corresponds to the amount of collected cooled hot ash particles that are discharged from the collector.

11. The method as claimed in claim 9, wherein:

the amount of the collected cooled hot ash particles that is discharged from the collector is controlled based on the temperature of the gas in the furnace that is operatively connected to the collector and to which are directed the collected cooled hot ash particles that are discharged from the collector.

12. The method as claimed in claim 9, wherein:

the collected cooled hot ash particles are at a relatively higher pressure; and the injected air is at a relatively lower pressure.

13. The method as claimed in claim 12, wherein:

the relatively higher pressure of the collected cooled hot ash particles is approximately 200 inches WG; and the relatively lower pressure of the injected air is approximately 65 inches WG.

14. The method as claimed in claim 9, wherein:

the injected air is operative to fluidize the collected cooled hot ash particles and to transport the collected cooled hot ash particles through a discharge opening for purposes of effecting the discharge of the collected cooled hot ash particles from the collector.

15. The method as claimed in claim 9, wherein the ash particles are first ash particles, the collector is a first collector and the air is first air, and further comprising the steps of:

directing a gravity flow of second hot ash particles;

collecting the second hot ash particles in a second collector; and injecting second air to control the amount of collected second hot ash particles that are discharged from the second collector.

16. The method as claimed in claim 15, wherein:

the injected second air is operative to fluidize the collected cooled second hot ash particles and to transport the collected cooled second hot ash particles through a discharge opening to effect the discharge of the collected cooled second hot ash particles from the collector; and the amount of the collected cooled second hot ash particles that are discharged from the second collector is controlled such that the amount of the collected cooled second hot ash particles that are collected in the second collector is sufficient to seal the second collector against a flow of an external gas through the discharge opening into the second collector.

* * * * *